United States Patent [19]

Souma et al.

[11] Patent Number: 5,012,982

[45] Date of Patent: May 7, 1991

[54] ELECTROMAGNETIC FUEL INJECTOR

[75] Inventors: Masahiro Souma, Hitachi; Tokuo Kosuge, Ibaraki; Tohru Ishikawa; Hisanobu Kanamaru, both of Katsuta; Mizuho Yokoyama, Katsuta; Yasuo Kamituma, Mito, all of Japan

[73] Assignees: Hitachi, Ltd., Tokyo; Hitachi Automotive Engineering Co., Ltd., Katsuta, both of Japan

[21] Appl. No.: 361,336

[22] Filed: Jun. 5, 1989

Related U.S. Application Data

[63] Continuation of Ser. No. 119,472, Nov. 12, 1987, abandoned.

[30] Foreign Application Priority Data

| | | | |
|---|---|---|---|
| Nov. 15, 1986 | [JP] | Japan | 61-272383 |
| Jan. 16, 1987 | [JP] | Japan | 62-6022 |
| Feb. 6, 1987 | [JP] | Japan | 62-24581 |

[51] Int. Cl.[5] ..... F02M 51/08

[52] U.S. Cl. ..... 239/585

[58] Field of Search ..... 251/129.15, 129.21; 239/585, 589; 29/156.7 R, 156.7 A

[56] References Cited

U.S. PATENT DOCUMENTS

| | | | |
|---|---|---|---|
| 4,291,960 | 9/1981 | Bauer | 251/205 |
| 4,310,123 | 1/1982 | TePastte | 239/585 |
| 4,311,280 | 1/1982 | Knape | 239/585 |
| 4,360,161 | 11/1982 | Claxton et al. | 239/463 |
| 4,403,741 | 9/1983 | Moriya et al. | 239/585 |
| 4,423,843 | 1/1984 | Palma | 239/585 |
| 4,483,485 | 11/1984 | Kamiya et al. | 239/585 |
| 4,526,145 | 7/1985 | Honma et al. | 123/357 |
| 4,578,009 | 3/1988 | Giraudi | 239/585 |
| 4,648,559 | 3/1987 | Fuller | 239/585 |
| 4,725,041 | 2/1988 | Chauvin et al. | 251/129.15 |
| 4,771,984 | 9/1988 | Szablewski et al. | 239/585 X |
| 4,887,769 | 12/1989 | Okamoto et al. | 239/585 X |

FOREIGN PATENT DOCUMENTS

| | | |
|---|---|---|
| 0051009 | 5/1982 | European Pat. Off. . |
| 0172591 | 2/1986 | European Pat. Off. . |
| 23004581 | 3/1972 | Fed. Rep. of Germany . |
| 2532005 | 2/1983 | France . |
| 2606088 | 10/1987 | France . |
| 8804727 | 10/1988 | PCT Int'l Appl. . |
| 2039993 | 8/1980 | United Kingdom . |
| 2057193 | 3/1981 | United Kingdom . |

*Primary Examiner*—Andres Kashnikow
*Assistant Examiner*—Kevin P. Weldon
*Attorney, Agent, or Firm*—Antonelli, Terry, Stout & Kraus

[57] ABSTRACT

An electromagnetic fuel injector comprising: a movable member with a valve body provided at one end and an armature made of a magnetic material provided at the other end; a cylindrical core made of a magnetic material, the core being disposed in such a manner that the distal end thereof opposes the armature; an electromagnetic coil disposed around the cylindrical core for producing an electromagnetic force between the cylindrical core and the armature when the coil is energized; and guide sections for guiding the movement of the movable member in the axial direction, the guide sections being disposed in the vicinities of the valve body and the armature of the movable member. The guide section provided in the vicinity of the armature comprises a sliding member made of a non-magnetic material and disposed between the armature and the core. The colliding surface of the core and the armature is coated with a nickel layer which serves as an impact absorbing layer and a chromium oxide layer which serves as a surface hardening layer. A seal ring is provided between the outer periphery of a plug portion of the core and the inner periphery of a casing. The yoke is coupled to the core at a location which is closer to a fuel outlet from the seal ring.

17 Claims, 4 Drawing Sheets

ELECTROMAGNETIC FUEL INJECTOR

This application is a continuation of application Ser. No. 119,472, filed Nov. 12, 1987 now abandoned.

BACKGROUND OF THE INVENTION

1. FIELD OF THE INVENTION

The present invention relates to an electromagnetic fuel injector used in an internal-combustion engine.

2. DESCRIPTION OF THE PRIOR ART

Japanese Patent Publication No. 11071/81 discloses an electromagnetic fuel injector which includes a movable member having a valve body at one end and an armature made of a magnetic material mounted on the other end thereof. In this fuel injector, the movable member is moved back and forth linearly along the axis of the fuel injector, guided by two guides mounted on portions of a plunger connecting the valve body and the armature which are located near the valve body and armature, respectively.

The above-described known art, however, suffers from problems in that the two guides cannot be spaced sufficiently from each other so that the valve body cannot be retained accurately on the axis of the fuel injector, despite the two-point support.

SUMMARY OF THE INVENTION

Accordingly, an object of the present invention is to provide an electromagnetic fuel injector which is so designed as to have guides which are spaced by a longer gap than that in the conventional fuel injector, while the overall length of the fuel injector remains the same, so as to ensure that the valve body can be retained accurately on the axis of the fuel injector.

The above-described object of this invention can be achieved by constructing the guide located near the armature in such a manner that the armature is guided against the core by a sliding member which is made of a non-magnetic substance and which is interposed between the armature and the core.

The above-described object of this invention can also be achieved by using as a guide a retaining member which retains the armature and the core concentrically and which is made of a non-magnetic substance.

In the thus-arranged electromagnetic fuel injector of this invention, the armature located at the end of the movable member is guided by the core, ensuring a sufficiently long distance between the guide located near the armature and the other guide located near the valve body, when the length of the entire fuel injector remains the same as that of the conventional fuel injector.

This arrangement enables the movable member to be moved in the axial direction in a state wherein the axis of the movable member is accurately aligned with the axis of the fuel injector, eliminating problems relating to the unbalanced contact of the valve body with the valve seat and the consequent loss of reproducibility of the characteristics of the injection amount.

DESCRIPTION OF THE PREFERRED EMBODIMENTS

Figure 1:
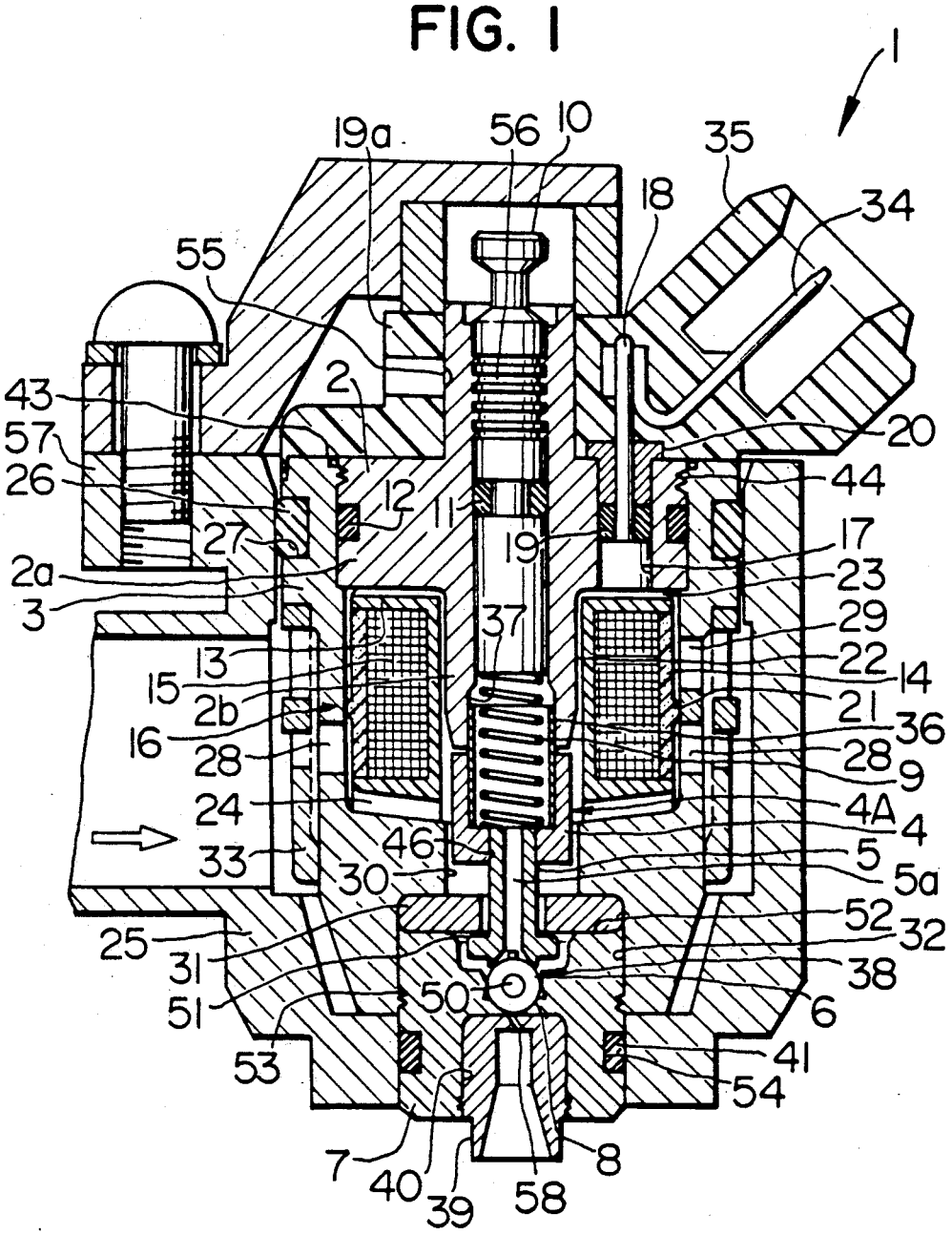
FIG. 1 is a cross-sectional view of an electromagnetic fuel injector, showing a first embodiment of the present invention.

A first embodiment of the present invention will be described below with reference to FIGS. 1 to 3. A magnetic circuit is formed with a cylindrical yoke 3 having a bottom, a core 2 having a plug body portion 2*a* for closing an open end of the yoke 3 and a columnar portion 2*b* extending at the center of the yoke 3, and a plunger 4 which opposes the core 2 with a gap therebetween. The center of the columnar portion 2*a* of the core 2 is provided with a hole into which a spring 9 for resiliently pressing a movable section 4A against a fuel introducing seat surface 8 formed in a valve guide 7 is inserted, the movable section 4A consisting of the plunger 4, a rod 5, and a ball valve 6. The upper end of the spring 9 abuts against the lower end of a spring adjuster 10 inserted into the center of the core so as to enable the set load to be adjusted. An 0-ring 11 is provided between the core 2 and the adjuster 10 so as to prevent fuel from flowing to the outside through a gap between the core 2 and the adjuster 10. An 0-ring 12 is mounted between the core 2 and the yoke 3 so as to prevent flow-out of fuel through a gap therebetween. A coil 15 which energizes the magnetic circuit is wound on a bobbin 13, and the outside of the coil 15 is molded with a plastic material. A coil assembly 16 which consists of the coil 15, the bobbin 13, and the plastic mold has a terminal 18 which is inserted into a hole 17 formed in the collar portion of the core 2. An 0-ring 19 is mounted between the terminal 18 and the core 2. The hole 17 is covered by a collar 20 which prevents a mold resin 19*a* (hereinafter referred to as a yoke mold) located on the outside of the fuel injector 1 from entering into the inside thereof at the time of formation. An annular projection 21 is integrally formed with the mold resin 14 on the outer periphery of the coil assembly 16 so as to prevent bubbles in the fuel from entering into the interior of the fuel injector. Fuel and fuel vapor pass through a gap 22 formed between the core and the coil assembly 16, an upper passageway 23, and a lower passageway 24. The outer periphery of the yoke 3 is provided with an annular groove 27 in which an O-ring 26 is received so as to prevent fuel from flowing through the gap formed between the fuel injector 1 and a socket 25 serving as a casing A flow-in passageway 28 through which fuel flows into the fuel injector, as well as a flow-out passageway 29 through which an excessive fuel containing bubbles stored in the fuel injector flow out of the fuel injector, are opened in the yoke 3. A plunger receiving portion 30 which receives the movable section 4A is opened at the bottom of the yoke 3. Further, a valve guide receiving section 32, which has a larger diameter than that of the plunger receiving section 30 and which receives a stopper 31 and the valve guide 7, is formed at the bottom of the yoke 3. The outer periphery of the yoke 3 is provided with an annular filter 33 which prevents dust or foreign matters contained in the fuel or piping from flowing toward the valve seat from the fuel flow-in passageway 28. A terminal 34 which transmits signals to the coil 15 from a control unit is connected to the terminal 18. These terminals 34 and 18 are molded at the upper end of the electromagnetic valve assembly, thereby forming a mold connector 35. The movable section comprises the plunger 4 made of a magnetic material, the rod 5 connected to the plunger 4 at one end thereof, the ball valve 6 connected to the other end of the rod 5, and a guide ring 36 fixed at the upper opening of the plunger 4 an made of a non-magnetic material The guide ring 36 is guided by an inner wall 37 of a hollow portion opened at the distal end of the core 2, while the ball valve 6 is guided by a guide surface 38 of the valve guide 7. The cylindrical guide surface 38 which guides the ball valve 6 continues to the seat surface 8 which seats the ball valve 6 and whose center is provided with a fuel outlet. The valve guide 7 is provided with a cylindrical portion 40 which extends in a direction opposite from the seat surface 8 into which a swirl orifice 39 for atomizing fuel is received.

An O-ring 41 is mounted between the socket 25 and the outer periphery of the valve guide 7 so as to seal fuel. In this embodiment, an annular groove formed on the outer periphery of the valve guide 7 forms an O-ring receiving section 54.

The electromagnetic valve assembly is assembled as described below. The terminal 18 of the coil assembly 16 is inserted into the hole 17 formed in the collar portion of the core 2 in the state wherein the O-ring 19 is mounted about the terminal 18, and the collar 20 is then inserted into the hole 20 from above the terminal 18. Thereafter, the 0-ring 12 is fitted into the groove formed on the outer periphery of the plug body portion of the core, and the core is then fitted into the yoke 3.

In this state, a metal-flow pressing jig 42 is set to axially press the upper end of the inner peripheral portion 43 of the yoke 3 adjacent to the core, so that the metallic material of the yoke 3 is made to plastically flow radially into grooves 44 formed in the outer peripheral surface of the plug portion of the core 2, whereby a metal flow process is conducted to fix the yoke 3 to the core 2 by compressive force It is essential for the inner wall of the valve guide 7 receiving section 32 of the yoke 3 and the inner wall 37 of the core 2 to be made concentric with a high level of accuracy, since the movable section is moved back and forth in the axial direction while the ball valve 6 thereof is guided by the guide surface 38 of the valve guide 7 and the non-magnetic ring 36 is guided by the inner wall 37 formed in the distal end of the core 2. Therefore, the flow of metal is effected in the state wherein the inner wall of the valve guide receiving section 32 and the inner wall 37 of the core 2 are aligned with a high level of accuracy, by employing a pressure-receiving jig 45 shown in FIG. 2. Thereafter, the terminal 34 is fixed to the terminal 18 by caulking, soldering, or welding, and molding with resin is then performed. Subsequently, the valve guide assembly is assembled as described below. The valve guide assembly comprises the movable section and the valve guide. The movable section is formed as follows: the ball valve 6 and the rod 5 made of a quench-hardened stainless steel are connected by resistance or laser welding. Subsequently, the other end of the rod 5 and the plunger 4 are fixed to each other by causing a metal flow to occur therebetween, i.e., by causing the inner wall of the plunger 4 to flow into grooves 46 formed on the outer periphery of the rod 5. To fix the guide ring 36 to the plunger 4 by means of metal flow pressing jig 48, the surface 47 of the plunger 4 which is located near the ball valve is received by a pressure-receiving jig, and a guide ring contact portion 49 of the edge of the inner periphery of the plunger 4 is pressed in the axial direction by using a metal flow pressing jig 48, thereby applying compressive force to the guide ring in the radial direction thereof, as shown in FIG. 3. Thereafter, a side 50 of the ball valve 6 is grounded at four locations along the axis of movement, so as to form fuel supply passageway between the cylindrical guide surface 38 and the ball valve 6. The stroke of the movable section is determined by the dimension of the gap formed between a receiving surface 51 of a neck of the rod 5 and the stopper 31. This gap is adjusted by polishing a valve guide end surface 52 or the receiving surface 51 of the neck of the rod 5.

The valve guide assembly which has been assembled in the manner described above, together with the stopper 31, is inserted into the valve guide receiving section 32 of the yoke 3 of the electromagnetic valve assembly. The valve guide assembly and the electromagnetic valve assembly are fixed to each other by causing plastic flow to occur therebetween, i.e., by causing the inner peripheral wall at the distal end of the yoke 3 to plastically flow into grooves 53 formed on the outer periphery of the valve guide 7. At this time, the thickness of the stopper 31 is set to a value which ensures that the distal end of the plunger 4 does not make contact with the distal end of the core 2 when the movable section is attracted and that a predetermined air gap is provided therebetween. Subsequently, the adjuster 10 with the spring 9 attached to the distal end thereof and the 0-ring 11 mounted on the outer periphery thereof is inserted into the hole formed in the center of the core 2 of the electromagnetic valve assembly from the opposite direction from the valve guide 7, and the filter 33 and the 0-ring 26 are then mounted on the outer periphery of the yoke 3 before injection rate test is conducted on the valve temporarily accommodated in a clamping jig having the same shape as that of the socket 25. In the injection rate test, the swirl orifice 39 which ensures a predetermined injection amount in the state wherein the movable section is at a full stroke is selected and fixed to the swirl orifice receiving section 40 of the guide valve 7 by means of metal flow, first. Next, response of the movable section is determined by changing the load to the spring 9 so that a predetermined injection rate is ensured at a certain cycle and in a certain valve opening time. Thereafter, the adjuster 10 is fixed to the core by pressing the outer periphery of an upper projecting section 55 of the core 2 in the radial direction thereof through the hole formed in the molded resin, thereby causing the inner wall of the core to bite into grooves 56 of the adjuster 10.

The operation of the fuel injector of this invention will now be described. The movable section of the fuel injector 1 is operated by electrical signals supplied to the electromagnetic coil 15 so as to open and close the valve seat and thereby inject fuel. The electrical signals supplied to the coil 15 are in the form of pulses. When a current flows through the coil 15, a magnetic circuit is formed by the core 2, the yoke 3, and the plunger 4, so that the plunger 4 is attracted toward the core 2. The center of the rod 5 connecting the plunger 4 and the ball valve 6 is provided with a through-hole **5*a*** through which the interior of the non-magnetic ring and the fuel passageway formed around the ball valve communicate with each other As the plunger 4 moves, the ball valve 6, which is integrally formed therewith, also moves away from the seat surface 8 of the valve guide 7, opening the fuel outlet The fuel, whose pressure is adjusted by a fuel pump and a fuel pressure regulator (not shown), flows into the socket 25 from a fuel gallery 57 then into the interior of the electromagnetic valve assembly from the flow-in passageway 28 through the filter 33, passes through the passageway 24 at the lower portion of the coil assembly 16, the outer periphery of the plunger 4, the gap between the stopper 31 and the rod 5, and the outside 50 of the ball valve 6, and is supplied to the seat section. The fuel is injected into a suction pipe through a swirl hole 58 of the swirl orifice 39 when the valve is opened.

Figure 2:
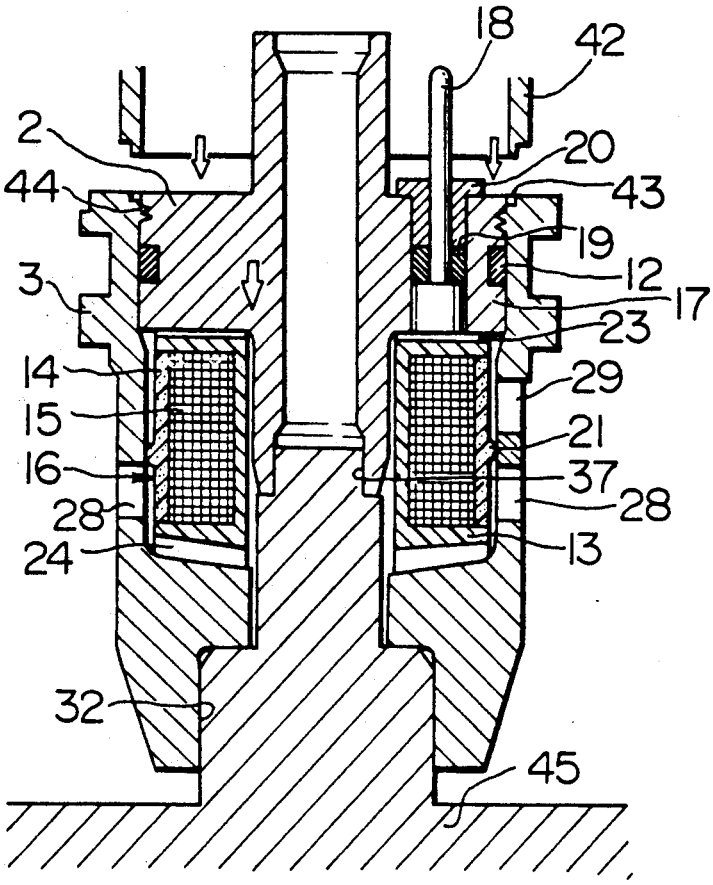
FIG. 2 illustrates how a yoke and a core are assembled together.
Figure 3:
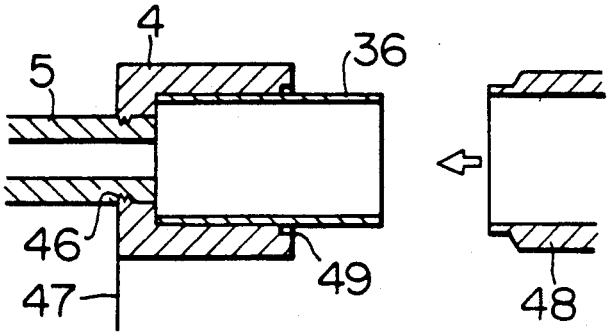
FIG. 3 illustrates how a movable section is assembled.

In FIG. 2, the metal flow pressing jig 42 applies force to the yoke 3 in the axial direction. However, the force applied to the core 2 acts only in the radial direction, causing the inner wall of the yoke 3 to flow plastically into the groove 44. This enables accurate concentricity of the core 2, the valve guide 7, and the movable section 4A to be attained by simply using the pressure-receiving jig 45 to obtain the accurate concentricity of the inner wall 37 at the distal end of the core 2 and the inner wall of the valve guide receiving section 32 at the distal end of the yoke 3.

Figure 4:
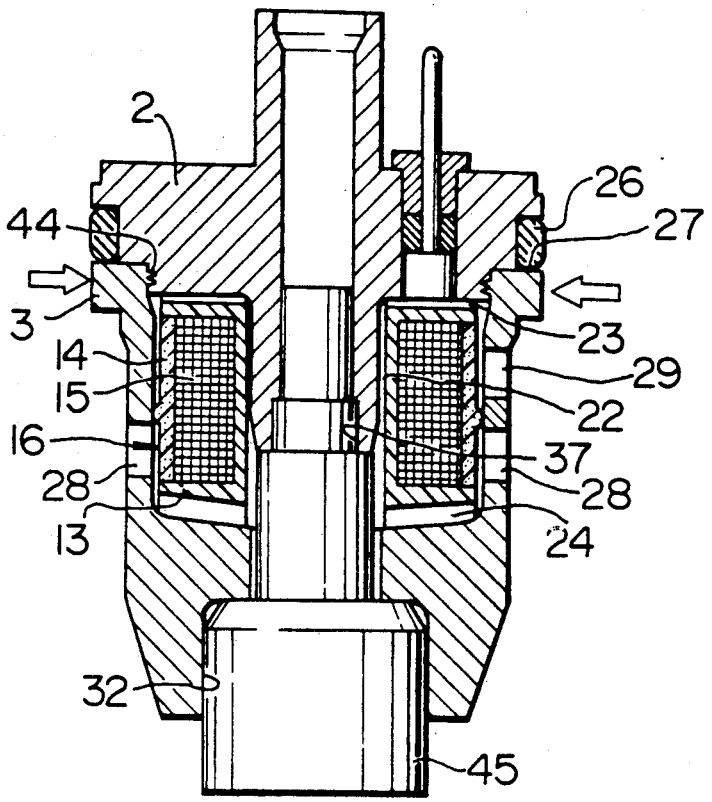
FIG. 4 shows another embodiment of the present invention.

This effect also can be attained by another embodiment shown in FIG. 4.

In this embodiment, the outer periphery of the upper edge of the yoke 3 is pressed radially at several locations or around its entire circumference in the radial direction so as to cause the inner wall of the yoke 3 to bite a protruding portion formed on the outer periphery of the core 2 which is positioned on an extension of the acting pressurizing force, and fix the yoke 3 thereto.

This method also ensures that the core 2 only receives force in the radial direction, with the result that the core 2 is maintained concentric with respect to other members.

If the fuel injector 1 is accommodated in the socket 25 in a state wherein the 0-ring 26 is provided in the annular groove 27 formed in the outer periphery of the core 2 at a location which is above the portion of the core 2 at which the core 2 is fixed to the yoke 3, as in this embodiment, the O-ring 26 can act to prevent leakage of fuel from between the inner periphery of the socket 25 and the outer periphery of the core 2, as well as from the connecting portion of the core 2 and yoke 3.

According to the present embodiment, the concentricity between the plug portion of the inner fixing member and the movable member, as well as the alignment of the columnar portion along the axis of movement of the movable member, can be ensured, thereby enabling the provision of an electromagnetic fuel injector which has a movable member that can be moved with a high level of accuracy and which enables the injection rate of fuel to be controlled with a high level of accuracy.

Further, since the inner and outer fixing members are joined to each other at a location which is below or nearer the fuel outlet from the sealing means provided between the inner fixing member and the casing, the sealing means for preventing fuel leakage from a gap between the inner fixing member and the casing can also act as a sealing means for sealing the gap between the inner and outer fixing members, decreasing the number of sealing means needed.

Thus, the movable section of the fuel injector according to the present invention is guided along the outer periphery of the ball valve and the outer periphery of the guide ring fixed to the inner periphery of the plunger, so that sufficient length of the guide can be ensured, even if the overall length of the movable section is reduced so as to reduce the weight thereof. Further, the guide ring can be slid smoothly because it is made of a non-magnetic material. This reduces the time required to attract the movable section, increasing the response and widening the dynamic range for the injection rate. It also improves reproducibility, increasing durability. In addition, since the ball valve is highly centripetal, the clearance formed in each of the guide sections can be made rougher than that of the conventional fuel injector. The time required to machine the members can be greatly reduced because the present embodiment employs metal flow which ensures accurate positioning of members that need not be machined to the high level of accuracy required in the conventional fuel injector.

As will be understood from the foregoing description, since the ball valve of the movable member of this embodiment is guided by the central guide hole of the valve guide while the movable member is guided on an opposite side from the ball valve by a non-magnetic material provided between the plunger and the core, a sufficient guide length can be ensured, even if the size and the weight of the movable member are reduced so as to widen the dynamic range, resulting in prevention of tilting of the movable member with respect to the axis of the fuel injector. If the weight of the movable member is reduced, the time required to attract it can be reduced, improving response and widening the dynamic range for the injection rate. If no tilting of the movable member occurs, the movement thereof becomes stable, improving the reproducibility of the characteristics of the injection rate. A decrease in the unbalanced loads caused by tilting reduces abnormal wear of the guide section, improving its durability.

Since the distance between the two guide sections can be made sufficiently long without increasing the overall length of the fuel injector according to the present invention, movement of the movable member in the axial direction can be made coincident with the axis of the valve with a high level of accuracy Therefore, problems involving the loss of reproducibility of the characteristics of the injection rate, which is caused by movement of the movable member in the axial direction in a state wherein it is tilted as well as the unbalanced contact between the valve body and the valve seat, can be eliminated, and stable fuel injection functions can be ensured.

In this embodiment, the movable member is guided along the inner wall of the core with the non-magnetic guide ring fixed to the distal end of the armature there through. However, the guide ring may also be guided along the outer periphery of the core.

It is not always necessary for the guide ring to have a cylindrical shape. It may be in any form in which it slides along the core at least at three location.

Further, the guide ring may be fixed not to the armature but to the core so as to guide the armature.

The guide ring may be formed as a sliding layer made of a non-magnetic material and which is formed on the outer periphery of the armature. In that case, the sliding layer may be formed by coating in place of an insertion of a ring.

At that time, the non-magnetic sliding layer may also be formed on the surface of the core against which the armature slides, i.e., on either of the inner and outer peripheral surfaces of the core.

Figure 5:
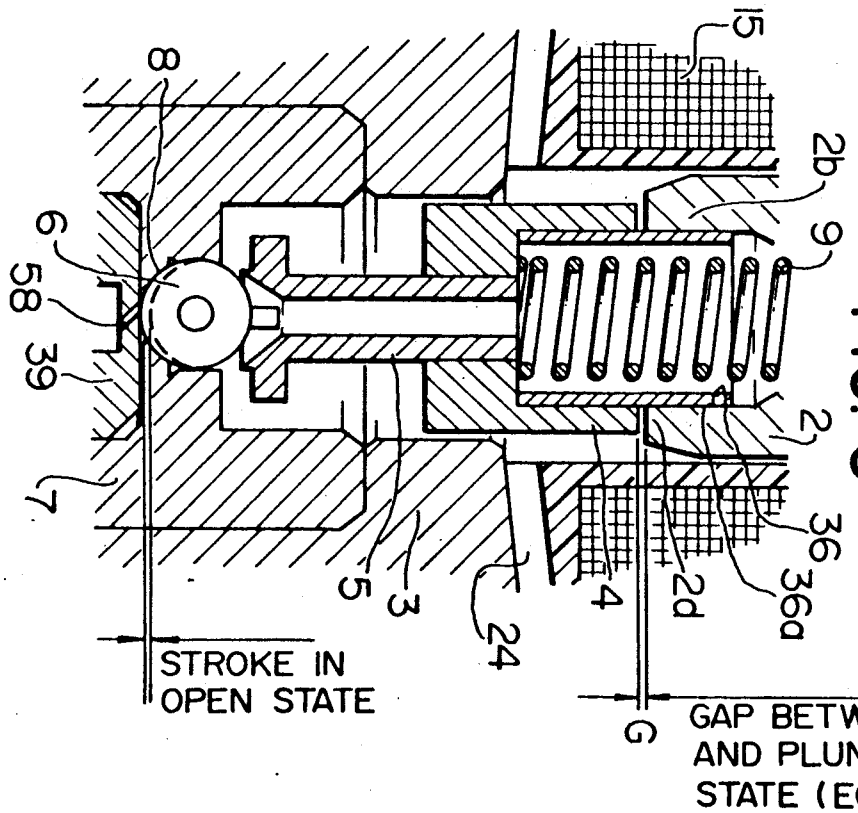
FIG. 5 is an enlarged cross-sectional view of an essential part of the fuel injector of FIG. 4.
Figure 6:
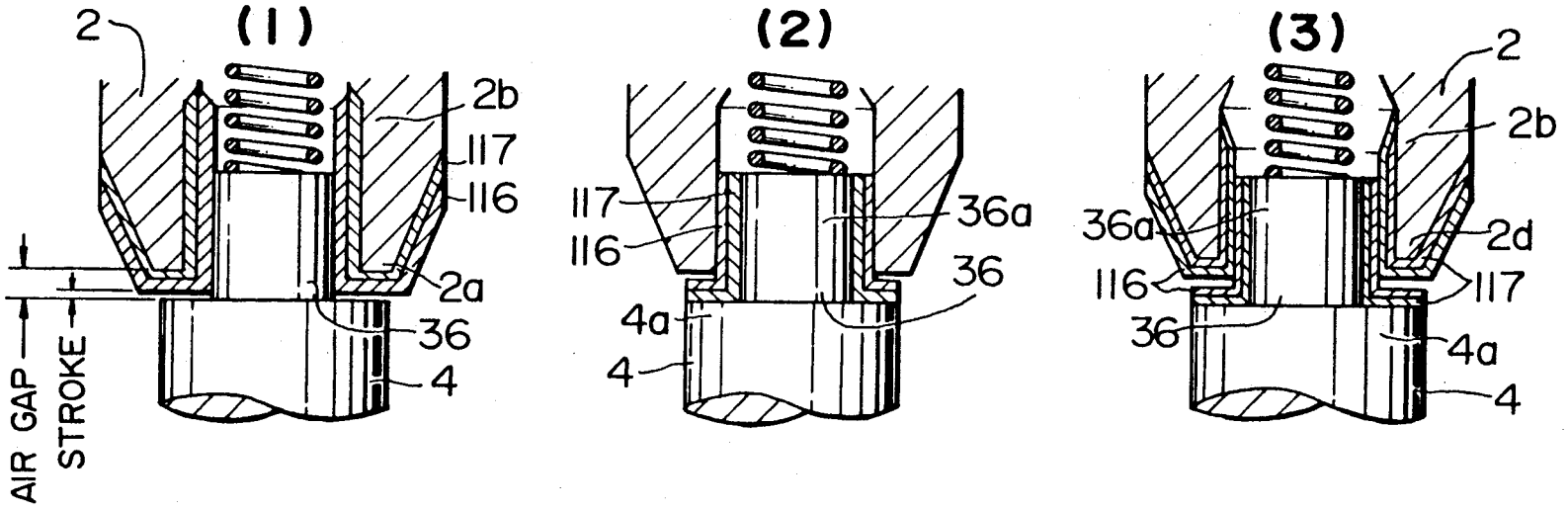
FIGS. 6 (1) to (3) are cross-sectional views of examples of ways of conducting wear-resistance surface treatment on the fuel injector.
Figure 7:
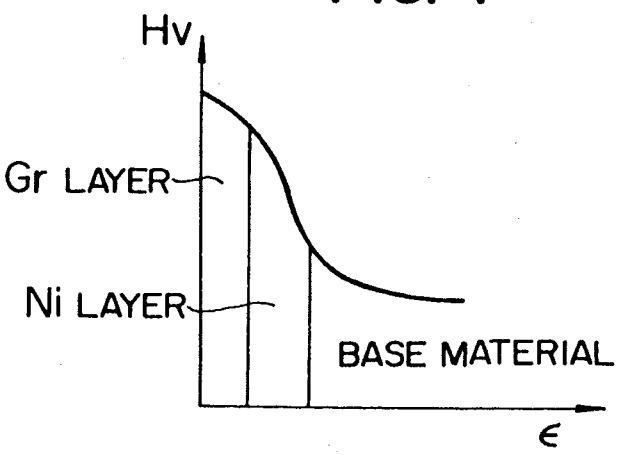
FIG. 7 is a graph of a hardness curve of the material used in the wear-resistance surface treatment.

FIG. 5 is a cross-sectional view of an essential part of the fuel injector FIGS. 6 (1) to (3) are cross-sectional views showing examples of surface treatment on the plunger which is a component of the magnetic circuit of the fuel injector, and FIG. 7 is a graph of hardness curve of a multilayer plating performed on the plunger shown in FIGS. 6 (1) to (3). The amount of gap formed between the seat surface 8 and the ball valve 6 when the fuel injector is opened is equivalent to the stroke of the valve assembly. The stroke of the valve assembly is determined by the gap G formed between a lower end surface 2*d* of the columnar portion 2*a* of the core 2 and an upper end surface 4*a* of the plunger 4, as shown in FIG. 5. In other words, the valve assembly of the fuel injector is moved back and forth through a distance which is equal to the gap G. In consequence, when the valve is opened, the lower end surface 2*d* of the core 2 collides with the upper surface of the plunger 4, thereby regulating the stroke of the valve assembly.

As such a collision repeatedly occurs, the end surfaces 2*d* and 4*a* of the core 2 and plunger 4 change (wear) with time. The changed end surfaces vary the stroke of the valve, resulting in change in the injection rate with time and degradation of operability of the internal-combustion engine.

The present embodiment is designed for overcoming the above-described disadvantages by performing any of following multilayer platings on the lower end surface 2*d* and an inner periphery 2*b* of the core 2 and/or the upper end surface 4*a* and an outer periphery 36*a* of a cylindrical portion 36 of the plunger 4 so as to improve wear-resistance.

FIGS. 6 (1) to (3) show examples of this multilayer plating. The example shown in FIG. 6 (1) involves the core 2 which is not so hard as the plunger 4 and is therefore susceptible to wear at the time of collision. In this case, the end surface 2*a* of the core and the inner periphery 2*b* thereof which is located in the vicinity of the end surface 2*a* are plated with a multilayer consisting of a chromium layer 116 which serves as an outer layer and a nickel layer 117 serving as an inner layer. FIG. 7 is a graph showing the hardness curve of this plated multilayer. As shown in FIG. 7, the hardnesses of the chromium layer 116, nickel layer 117, and core 2 are set in that order with the chromium layer 116 having the largest hardness The hardness of the nickel layer 117 is made different from that of the chromium layer 116, whereby the outer chromium layer 116 functions as a wear-resistant layer while impact of the loads applied to the outer chromium layer 116 is absorbed by an elastic action of the nickel layer 117, increasing durability of the chromium layer 116 when compared with the case where a single chromium layer is provided and preventing crack and peel-off thereof. The air gap G of the fuel injector is determined by the thickness of the multilayer.

The example shown in FIG. 6 (2) involves the reverse case wherein the plunger 4 is not so hard as the core 2 and the plunger 4 is susceptible to wear as they collide with each other. In this case, the upper end surface 4*a* of the plunger 4, as well as the outer periphery 36*a* of the cylindrical portion 36 thereof which is located in the vicinity of the upper end surface 4*a*, are plated with a multilayer which consists of the same layers as those in the example shown in FIG. 6 (1) (the chromium layer 116 and the nickel layer 117).

The example shown in FIG. 6 (3) involves the case wherein the plunger 4 and the core substantially have the same hardness and both of them are therefore susceptible to wear when they collide with each other. In this case, both of the core 2 and the plunger 4 are plated with the multilayer which consists of the same layers as those in the examples shown in FIGS. 6 (1) and (2) so as to improve wear resistance and absorb the impact imparted to the chromium layer 116.

The multilayer in the above-described examples consists of the chromium layer 116 which acts as a surface hardening layer and the nickel layer 117 which absorbs impact (serving as a soft layer). However, the hardnesses of the two layers can be made different even if the multilayer comprises a chromium oxide layer serving as a surface hardening layer and a chromium layer acting as an impact absorbing layer.

Further, surface treatment may also be conducted in the following manner: a nickel layer is formed on the surface to be wear-resistance treated, and hard particles (such as chromium oxide, silicon dioxide, and alumina) are dispersed in the nickel matrix of the nickel layer located in the vicinity of the surface during formation of the nickel layer. In this case, the surface hardening layer comprises a layer of nickel with hard particles dispersed in nickel matrix, and the impact absorbing layer is composed of a nickel layer.

According to the present invention, it is possible to prevent wear of the colliding surface by the provision of the surface hardening layer thereon. It is also possible to absorb impact loads applied to the surface hardening layer under the action of the impact absorbing layer, thereby effectively preventing crack and peel-off of the surface hardening layer. The surface hardening layer and the impact absorbing layer may be selectively provided on either of the movable members and the core or on both of them, depending on the material of the movable member and the core. For example, if the movable member is harder than the core and therefore the core is susceptible to wear, they may be formed on the core side. In a reversed situation, the two layers are plated on the movable member. Or if the movable member and the core are both susceptible to wear, the two layers may be formed on both of them.

We claim:

1. An electromagnetic fuel injector comprising a cylindrical yoke opened at its respective ends; a cylindrical core made of magnetic material connected with one end of said yoke and having a distal end extending into said yoke; an electromagnetic coil supported between said core and said yoke; a valve guide fixed in the other end of the yoke and including a guide part for a ball valve located at a position remote from said electromagnetic coil; an elongated movable member with a ball valve provided at one end and an armature made of a magnetic material provided at the other end thereof; said elongated moveable member being disposed in such a manner that the distal end of said cylindrical core opposes said armature and said ball valve is disposed adjacent said guide part remote from said electromagnetic coil; said electromagnetic coil being disposed around said cylindrical core for producing an electromagnetic force between said cylindrical core and said armature when said coil is energized to effect axial movement of said elongated moveable member; and a guide member for guiding the movement of said elongated movable member in the axial direction and being disposed in the vicinity of said armature of said elongated movable member, said guide member provided in the vicinity of said armature of said elongated movable member being composed of a hollow sliding member made of an on-magnetic material disposed between and engaging with said armature and the distal end of said core so that magnetic flux from said electromagnetic coil does not pass therethrough; and wherein a sliding surface of the sliding member and an open inner wall surface of the yoke to which the valve guide is fixed are precisely coaxial.

2. An electromagnetic fuel injector according to claim 1, wherein said sliding member made of the non-magnetic material is composed of a cylindrical body, one end of which is fixed to said armature and the other end of which slides along the inner periphery of said cylindrical core.

3. An electromagnetic fuel injector, comprising: a cylindrical yoke opened at its respective ends; a cylindrical core made of magnetic material connected with one end of said yoke; and electromagnetic coil supported between said core and said yoke; a valve guide fixed in the other end of the yoke and including a guide part for a ball valve located at a position remote from said electromagnetic coil; an elongated movable member with a ball valve provided at one end and an armature made of a magnetic material provided at the other end thereof; said elongated moveable member being disposed in such a manner that a distal end of said cylindrical core opposes said armature and said ball valve is disposed adjacent said guide part remote from said electromagnetic coil; said electromagnetic coil being disposed around said cylindrical core for producing an electromagnetic force between said cylindrical core and said armature when said coil is energized to effect axial movement of said elongated moveable member; and a guide member for guiding the movement of said elongated movable member in the axial direction and being disposed in the vicinity of said armature of said elongated movable member, the guide member in the vicinity of said armature being formed of a hollow retaining member provided between and engaging with the distal end of said core and said armature for maintaining said core and said armature in a coaxial state, said retaining member being formed precisely coaxial with respect to an open inner wall surface of said yoke to which the valve guide is fixed.

4. An electromagnetic fuel injector according to claim 3, wherein said retaining member is composed of a retaining body made of a non-magnetic material, one end of which is fixed to said armature and the other end of which is inserted into said cylindrical core in such a manner that it can slide along the inner periphery of said core.

5. An electromagnetic fuel injector according to claim 1, wherein either of the colliding surfaces of said movable member and said core at which they collide with each other or both of said colliding surfaces are coated with a wear-resistant surface hardening layer, and an impact absorbing layer is interposed between said surface hardening layer and said colliding surface to absorb the impact caused when said movable member and said core collide with each other.

6. An electromagnetic fuel injector according to claim 5, wherein said surface hardening layer is composed of a chromium layer, and said impact absorbing layer is composed of a nickel layer.

7. An electromagnetic fuel injector according to claim 5, wherein said surface hardening layer is composed of a chromium oxide layer, and said impact absorbing layer is composed of a chromium layer.

8. An electromagnetic fuel injector according to claim 5, wherein said surface hardening layer is composed of a layer of nickel with hard particles dispersed therein, and said impact absorbing layer is composed of a nickel layer.

9. An electromagnetic fuel injector according to claim 3, wherein at least one of the surfaces of said movable member and said core which collide with each other are coated with a wear-resistant surface hardening layer, and an impact absorbing layer is interposed between said surface hardening layer and said colliding surface to absorb the impact caused when said movable member and said core collide with each other.

10. An electromagnetic fuel injector, comprising: an electromagnetic valve assembly having a yoke having a cylindrical, open ended shape and being made of a magnetic material; an annular electromagnetic coil retained inside of said yoke; a core of magnetic material having a plug portion fixed to said guide for sealing one open end of said yoke and a columnar portion inserted into the center of said annular coil within said yoke; the other open end of said cylindrical yoke opposite said one end having a valve guide secured therein for guiding a ball valve; said valve guide including fuel outlet means provided at said other end of said yoke at a position remote from said electromagnetic coil; an elongated movable member having an armature which forms part of a closed magnetic circuit of said electromagnetic coil in cooperation with said yoke and said core at one end thereof, as well as a ball valve for opening and closing a fuel outlet of said fuel outlet means at the other end thereof remote from said one end; and elastic means for normally urging said elongated movable member in the direction in which said ball valve closes said fuel outlet means; said electromagnetic valve assembly being accommodated in a casing with sealing means therebetween; space formed between said casing and said yoke of said electromagnetic valve assembly forming a fuel passageway, said sealing means being interposed between the outer periphery of said plug portion of said core and the inner periphery of said casing,; and a non-magnetic hollow cylindrical sliding member engaging said armature and said core for guiding the movement of said armature is mounted on one of said armature and said core.

11. An electromagnetic fuel injector according to claim 10, wherein the inner wall of said yoke is caused to press against a protruding portion provided on the outer periphery of said core so as to fix said core to said yoke.

12. An electromagnetic fuel injector according to claim 10, wherein at least one of the surfaces of said movable member and said core which collide with each other are coated with a wear-resistant surface hardening layer, and an impact absorbing layer is interposed between said surface hardening layer and said colliding surface to absorb the impact caused when said movable member and said core collide with each other.

13. An electromagnetic fuel injector, comprising: a hollow cylindrical yoke having first and second ends; a cylindrical core connected at said first end of said yoke and having a distal end extending into the hollow interior thereof; a valve guide fixed in the second end of said yoke and including a guide part for a ball valve; an elongated moveable member having a ball valve provided at one end and an armature made of a magnetic material provided at the other end thereof, said moveable member being disposed between said core and said valve guide with said armature being adjacent the distal end of said core and said ball valve being within said guide part; an electromagnetic coil supported between said core and said yoke so as to be disposed around said core adjacent said armature of said moveable member for producing an electromagnetic force between said core and said armature to effect axial movement of said moveable member toward said core; stop means disposed between said ball valve and said armature for limiting the extent of the axial movement of said moveable member toward said core as produced by said electromagnetic coil; and a guide member for guiding the movement of said elongated moveable member in the axial direction, the guide member being disposed in the vicinity of said armature for effecting two-position support for said moveable member in cooperation with said guide part of said valve guide, the guide member in the vicinity of said armature being composed of a non-magnetic sliding member in the form of a hollow cylinder disposed between and engaging with said armature and the distal end of said core so that a sliding surface of said sliding member is precisely coaxial with the axis of said core and said moveable member.

14. An electromagnetic fuel injector according to claim 13, wherein said elongated moveable member has an annular projection intermediate said ball valve and said armature, and said stop means includes a fixed stop member having an aperture through which said moveable member extends, said stop member being disposed between said annular projection and said armature.

15. An electromagnetic fuel injector according to claim 13, wherein said elongated moveable member has a projection between said ball valve and said armature, and said stop means includes a fixed stop member aligned with said projection and disposed between said projection and said armature for limiting the extent of movement of said projection toward said core.

16. An electromagnetic fuel injector, comprising: an elongated moveable member having a ball valve provided at one end and an armature made of magnetic material provided at the other end thereof; means for supporting said moveable member for axial movement; a valve seat having a valve part disposed adjacent said ball valve; means for biasing said moveable member so that said ball valve contacts said valve seat; electromagnetic coil means disposed adjacent said armature of said moveable member for effecting axial movement of said moveable member to displace said ball valve away from said valve seat; stop means disposed between said ball valve and said armature for limiting the extent of the axial movement of said moveable member as produced by said electromagnetic coil means; and guide sections for guiding the movement of said elongated moveable member in the axial direction, the guide sections being disposed in the vicinities of said ball valve and said armature for effecting two-position support for said moveable member, the guide section in the vicinity of said armature being composed of a hollow cylindrical sliding member constructed of a non-magnetic material and engaging with a hollow end portion of said armature.

17. An electromagnetic fuel injector according to claim 16, wherein said elongated moveable member has a projection between said ball valve and said armature, and said stop means includes a fixed stop member aligned with said projection and disposed between said projection and said armature for limiting the extent of movement of said projection toward said core.

* * * * *